US007921621B2

(12) United States Patent
Krestel

(10) Patent No.: US 7,921,621 B2
(45) Date of Patent: Apr. 12, 2011

(54) SUPPORT-TYPE COMPONENT THAT IS COMPOSED OF INDIVIDUAL SECTIONS

(76) Inventor: Stefan Krestel, Graz (AT)

( * ) Notice: Subject to any disclaimer, the term of this patent is extended or adjusted under 35 U.S.C. 154(b) by 617 days.

(21) Appl. No.: 11/883,074

(22) PCT Filed: Jan. 24, 2006

(86) PCT No.: PCT/AT2006/000034
§ 371 (c)(1),
(2), (4) Date: Jul. 26, 2007

(87) PCT Pub. No.: WO2006/079134
PCT Pub. Date: Aug. 3, 2006

(65) Prior Publication Data

US 2008/0148657 A1 Jun. 26, 2008

(30) Foreign Application Priority Data

Jan. 27, 2005 (AT) ..... A 130/2005

(51) Int. Cl.
*E04C 3/00* (2006.01)

(52) U.S. Cl. ..... 52/847; 52/846; 52/693; 52/836; 52/793.1

(58) Field of Classification Search ..... 52/635, 52/642, 690, 693, 694, 696, 836, 846, 847, 52/793.1
See application file for complete search history.

(56) References Cited

U.S. PATENT DOCUMENTS

| | | | | | |
|---|---|---|---|---|---|
| 735,920 | A | * | 8/1903 | Visintini | 52/600 |
| 1,011,583 | A | * | 12/1911 | Collins | 52/693 |
| 1,013,698 | A | * | 1/1912 | Tashjian | 52/693 |
| 1,405,889 | A | * | 2/1922 | Barling | 52/693 |
| 1,542,507 | A | * | 6/1925 | Kearney | 52/690 |
| 1,598,129 | A | * | 8/1926 | Gersman | 52/635 |
| 4,001,999 | A | * | 1/1977 | Chandler | 52/693 |
| 4,228,631 | A | * | 10/1980 | Geffe | 52/690 |
| 4,291,515 | A | * | 9/1981 | Harding | 52/694 |
| 4,348,850 | A | * | 9/1982 | Reeder et al. | 52/693 |
| 4,442,650 | A | * | 4/1984 | Sivachenko | 52/694 |
| 4,475,328 | A | * | 10/1984 | Reeder et al. | 52/693 |
| 4,485,606 | A | * | 12/1984 | Gottlieb | 52/694 |
| 4,523,419 | A | * | 6/1985 | Palacio et al. | 52/690 |
| 4,947,612 | A | * | 8/1990 | Taylor et al. | 52/693 |
| 5,079,894 | A | * | 1/1992 | Lau | 52/847 |
| 5,377,472 | A | | 1/1995 | Terenzoni | |

(Continued)

FOREIGN PATENT DOCUMENTS

| | | |
|---|---|---|
| FR | 2 439 276 | 5/1980 |
| WO | WO 85/03968 | 9/1985 |

*Primary Examiner* — Robert J Canfield
*Assistant Examiner* — Matthew J Gitlin
(74) *Attorney, Agent, or Firm* — Dickstein Shapiro LLP

(57) ABSTRACT

A beam-like structural component (1) made up of individual parts, comprising a flange (2) and two webs (3, 4) is characterized in that a flange (2) is provided with one web (3, 4) each on its two longitudinal sides, wherein each web is attached to a longitudinal sidewall of the flange (2) preferably by means of an adhesive material, and that the end regions (7) of the webs (3, 4), which end regions are facing away from the flange (2), are planarly interconnected with the surfaces (8, 9) facing each other preferably by means of an adhesive material, wherein the webs (3, 4), in their cross-sections, have in each case the shape of a "stretched S".

18 Claims, 3 Drawing Sheets

U.S. PATENT DOCUMENTS 5,664,393 A * 9/1997 Veilleux et al. ..... 52/837
5,996,305 A 12/1999 Holbert et al.
6,212,846 B1 * 4/2001 Johnston ..... 52/648.1
6,293,057 B1 * 9/2001 Amos Hays ..... 52/79.1
6,497,080 B1 * 12/2002 Malcolm ..... 52/846
2004/0074205 A1 * 4/2004 Stache ..... 52/783.11

* cited by examiner

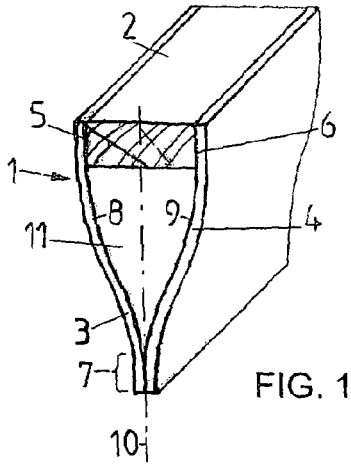
FIG. 1
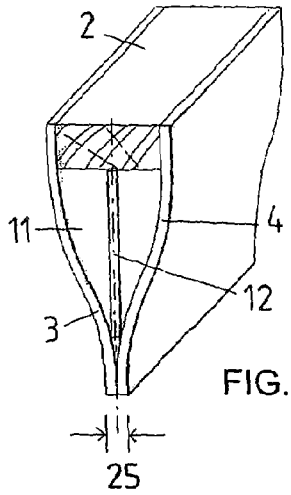
FIG. 2
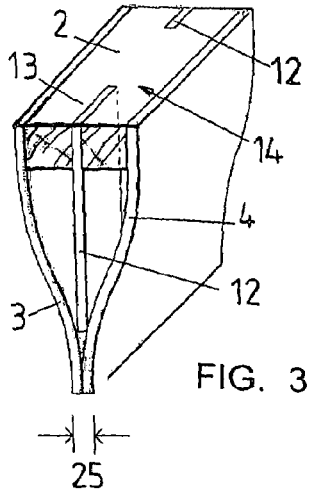
FIG. 3
FIG. 4
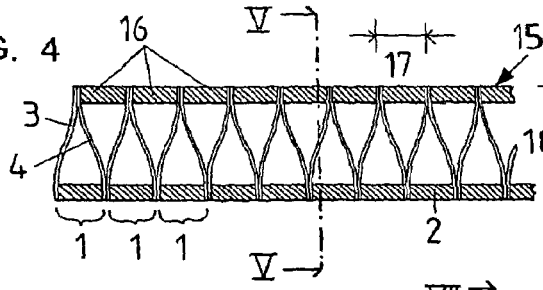
FIG. 5
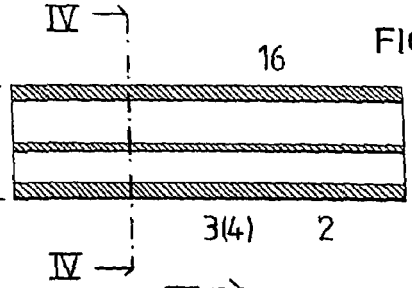
FIG. 6
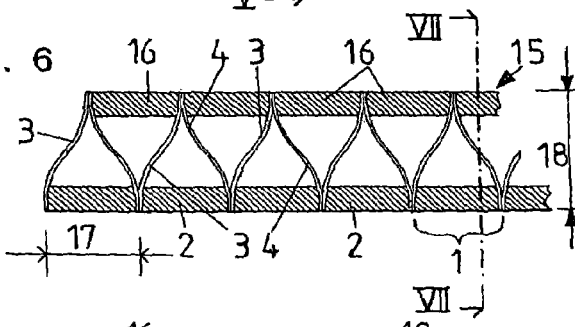
FIG. 7
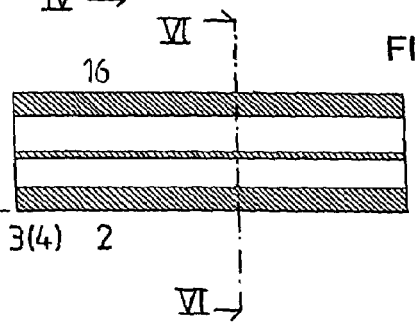
FIG. 8
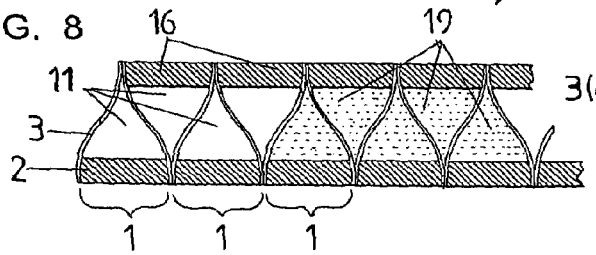
FIG. 9
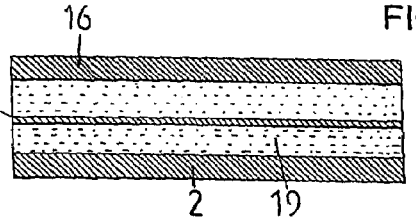
FIG. 10
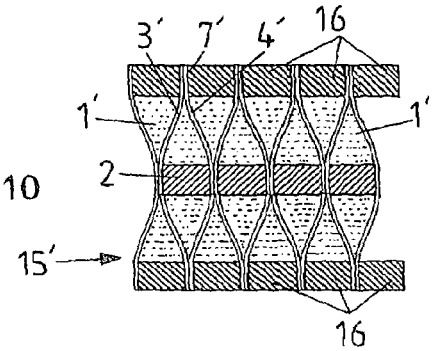

SUPPORT-TYPE COMPONENT THAT IS COMPOSED OF INDIVIDUAL SECTIONS

The invention concerns a beam-like structural component made up of individual parts, comprising a flange and two webs, as well as a constructional element formed thereof. Furthermore, the invention concerns a process and a device for manufacturing said structural component.

Structural components of this kind which, in their cross-sections, form a triangle with the flange and the two webs are known. Structural components of this kind are produced as an extrusion profile. It is the object of the invention to provide a structural component of this kind which is made up of individual parts so that the structural component can optionally be formed from different materials or from materials, respectively, which have been treated differently, i.e., prefabricated differently, for the flange and the webs. Furthermore, the structural component is supposed to exhibit a high load-bearing capacity as well as a high torsional rigidity and, in particular, is to be manufacturable in a simple manner.

According to the invention, said object is achieved in that a flange is provided with one web each on its two longitudinal sides, wherein each web is attached to a longitudinal sidewall of the flange preferably by means of an adhesive material, and in that the end regions of the webs, which end regions are facing away from the flange, are planarly interconnected with the surfaces facing each other preferably by means of an adhesive material, wherein the webs, in their cross-sections, have in each case the shape of a "stretched S" and wherein each web, advantageously, covers the entire longitudinal sidewall of the flange to which it is attached across the entire height thereof.

Preferably, the ends of the webs extending along the longitudinal sidewall of the flange terminate flush with at least a portion of the outsides of the flange, particularly due to machining on the assembled structural component or on a blank of the structural component, respectively.

In order to achieve a high load-bearing capacity with, at the same time, good torsional rigidity, the ratio of the width of the flange to the height of the web ranges between 1:20 and 1:1, preferably from 1:6 to 1:1, in particular from 1:3.5 to 1:2.5.

The structural component is preferably characterized in that it is formed entirely of wood, with the flange preferably being manufactured from sawn timber and the webs preferably being manufactured from plywood, the webs suitably being formed from a three-layered plywood and the wood fibres of the two outer layers of the plywood extending in the longitudinal direction of the structural component. Constructions of this kind provide a particularly good ratio between the dead weight and the load-bearing strength. In addition, low-grade sawn timber from the sawmill industry can be used for the flange, resulting in an increase in the added value of said timber.

If the structural component is joined together by adhesive materials, glues, in particular synthetic resin glues and PU-glues, are preferably used as adhesive materials for wood. Modem adhesives which are microwave or UV-curing offer further possibilities. It is likewise possible to use a film glue instead of a liquid glue.

Preferably, the cavity formed by the webs and the flange is filled with a material such as, for example, silica sand, cellulose flakes, a foamed material, PU-foam, etc. The filling leads to solutions for all kinds of problems, such as, e.g., for satisfying thermic and acoustic demands. As desired, the filling can occur prior to or after the installation of the structural component, the latter involving the advantage of easier manipulation, particularly since in that case only the light-weight hollow structural components have to be transported.

A structural component with a symmetrical cross-section characterized in that the planarly interconnected end regions of the webs lie in the centre of the width of the flange is advantageous in terms of stress.

In order to increase the load-bearing capacity, an intermediate web extending from the flange as far as to the planarly interconnected end regions of the webs is provided, with the intermediate web advantageously abutting the inside of the flange or, according to a different embodiment, extending to the outside of the flange, passing through the latter. It is not necessary for the intermediate web to extend across the entire length of the structural component, but it can be inserted from the ends or it can be introduced into said component through a slot in the flange.

A further increase in the load-bearing capacity is produced if the intermediate web is connected to the structural component by means of an adhesive.

A modified embodiment of a structural component is characterized in that the two webs attached to the flange extend toward either sides of the flange and both end regions of the two webs are planarly interconnected with the surfaces facing each other, the webs in each case having a "double-S" in their cross-sections. The flange is thereby advantageously arranged on a central plane of symmetry of the structural component.

Structural components according to the invention can be assembled to form constructional elements by arranging them side by side and by attaching them to each other, whereby, advantageously, at least two structural components are arranged so as to lie next to each other, the flanges of the two structural components form a surface and the structural components are interconnected with the end regions of the webs arranged on the flanges, which end regions are adjacent in this case, preferably by means of an adhesive, and whereby, furthermore, a flange located opposite the flanges of the structural components is inserted between the two free planarly interconnected end regions of the webs of the adjacent structural components and is connected to the end regions of the planarly interconnected webs preferably by means of an adhesive.

A plurality of structural components located next to each other in this manner and comprising a plurality of flanges located opposite the flanges of the structural components result in a plate-shaped constructional element.

Plate-shaped constructional elements are known in various variants. AT 285 129 A, for example, shows a wall element formed by two spaced-apart cover walls assembled from boards, between which walls boards are inserted in a zigzag arrangement, which, in each case, will lie against the two cover walls. If need be, they are glued to the cover walls. This structure is not only heavy but also very complicated to produce.

From WO 02/06606 A1, a plate-shaped structural component is known, wherein two spaced-apart cover plates are likewise connected to intermediate webs, the webs, in each case, extending at right angles to the two cover plates.

Furthermore, plate-shaped constructional elements between which a zigzag-shaped insert is likewise provided either in a lying or in a standing position, whereby a honeycombed structure is formed, are also known from GB 560913 A. A honeycombed structure between plate elements is also known from AT 196 113 A.

Furthermore, the invention concerns a process for manufacturing a structural component of the type according to the invention. Said process is characterized in that webs are attached, preferably stuck, to a flange, preferably made of sawn timber, which webs extend vertically away from the flange on the longitudinal side faces, whereby a U-shaped cross-section of a structural-component blank is formed, whereupon the free end regions of the webs, which end regions are located opposite the flange, are inserted into a groove tapering in a wedge-shaped manner and merging into a groove with parallel walls at its most narrow point and are contacted with each other due to the wedge form by moving the structural-component blank along the wedge-shaped groove as far as into the groove with parallel walls, while being deformed, and remain in contact in the groove with parallel walls, the insides of the webs, which insides are contacting each other, previously having been provided with an adhesive material.

The movement of the structural-component blank along the grooves is preferably effected by means of a pulling member extending along the structural-component blank, such as a rope which is attached to an end of the structural-component blank and is pulled with the aid of a winch. Of course, the structural-component blank can also be displaced along the groove via compressive forces.

A device for manufacturing a structural component according to the invention is characterized by a groove which is wedge-shaped in the longitudinal direction and whose largest width is equal to or larger than the sum of the width of the flange and the two thicknesses of the webs and whose most narrow width is equal to or slightly larger than the two thicknesses of the webs in total, and by a groove with parallel walls in the longitudinal direction which is adjacent or attachable to the most narrow width of the wedge-shaped groove and whose longitudinal extension is parallel to the longitudinal extension of the wedge-shaped groove and whose width roughly corresponds to the most narrow width of the wedge-shaped groove, with the depth of the two grooves corresponding at least approximately to the width of the end regions of the webs of the structural component, which end regions are to be connected.

A preferred embodiment is characterized by a motion device moving a structural-component blank through the wedge-shaped groove into the groove with parallel walls, preferably a motion device pulling the structural-component blank, such as a rope-pull device, whereby a rope-pull device whose rope can be moved along the structural-component blank as far as to the end thereof and can be attached there has proven to be advantageous for this purpose.

For series production, it is suitable if two or more grooves having parallel walls and being arranged next to each other and one wedge-shaped groove which can be moved from one groove to another groove in alignment therewith are provided.

The internal stress of the webs, especially if they are formed from plywood, within the groove with parallel walls is so large that compressive forces toward the outside, i.e., in the effective direction perpendicular to the groove base away from the groove, are produced, which compressive forces might cause the structural component to jump out. Consequently, a counterpressure in the direction of the groove perpendicularly to the groove base is suitable. Said counterpressure is produced due to the fact that a force-transducing guide means is provided in the clearance of the groove upon which the flange of the structural-component blank will abut.

BRIEF DESCRIPTION OF THE DRAWINGS

Below, the invention is illustrated further by way of several exemplary embodiments which are depicted in the drawing. FIGS. 1, 2 and 3 each show oblique views of structural components in various variants. FIGS. 4 to 10 show constructional elements assembled from individual structural components in cross sections and in longitudinal sections.

DETAILED DESCRIPTION OF THE PREFERRED EMBODIMENTS

Figure 11:
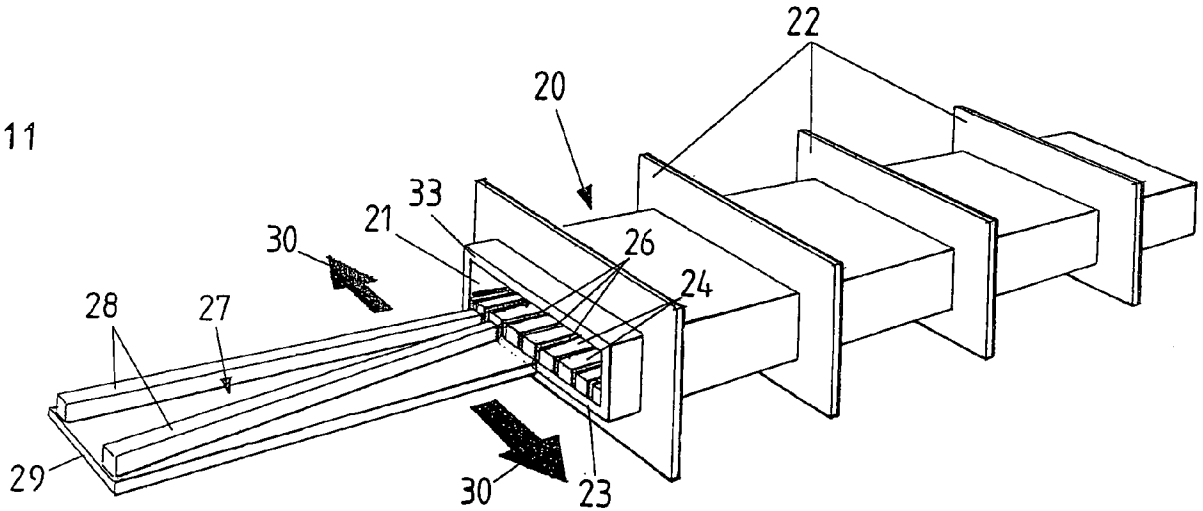
In FIGS. 11 and 12, oblique views of a device for producing a structural component are shown.

The structural component 1 illustrated in FIG. 1 is formed by a flange 2 and two webs 3, 4, wherein the webs are attached to the lateral faces 5, 6 of the flange 2, i.e., to the narrow edge faces thereof, preferably by bonding. The two free ends of the webs 3, 4 are planarly interconnected with their end regions 7, namely with the surfaces 8, 9 facing toward each other, and preferably also by means of an adhesive material. Because of this, the webs 3, 4 exhibit, in each case, the shape of a stretched S in their cross-sections. Preferably, the flange 2 is made of sawn timber, which is cheaply provided by the sawmill industry and can also be assembled in the longitudinal direction from several individual parts interconnected in a conventional way. Suitably, the webs 3, 4 are made of plywood, preferably of a three-layered plywood, the two outer layers extending with their longitudinal fibres alongside the structural component. The structural component has a bisecting line 10 in its cross-section, which means that the two interconnected end regions 7 of the webs 3, 4 will end up lying vertically in the centre of the width extension of the flange 2.

The structural component 1 according to the invention has the advantage that, in principle, it can be formed from all kinds of materials on the whole and also from various materials for the flange 2 and the webs 3, 4, respectively, wherein, for the webs 3, 4, predominantly materials are considered which are able to absorb shearing forces and, in addition, are flexible and preferably glueable. The webs 3, 4 can, for example, be made of cardboard, plastic, sheet metal, multi-layered plywood or other wood materials. It is likewise possible to make the flange 2 from various materials such as plastic, cardboard, multi-layered plywood or also from metal.

According to the embodiment illustrated in FIG. 2, an intermediate web 12 is inserted in the cavity 11 enclosed by the flange 2 and the webs 3, 4, which intermediate web is introduced from the end sides of the structural component 1. Said intermediate web 12, which optionally is formed from the same material as the webs 3, 4, can be connected to the webs 3, 4 or to the flange 2, respectively, by bonding.

According to the embodiment illustrated in FIG. 3, intermediate webs 12 are inserted in slotted recesses 13 of the flange 2, extending as far as to the outside 14 of the flange 2. The variants of the structural component 1 as illustrated in FIGS. 2 and 3 provide an extra-high bearing strength with an increased torsional strength.

The constructional element 15 illustrated in FIGS. 4 and 5 is formed from several structural components 1 according to FIG. 1, which are arranged side by side and are connected to each other, wherein the respective free ends of the interconnected webs 3, 4 of the individual structural components 1 are interconnected via a flange 16, preferably also by gluing. In FIG. 6, a constructional element is illustrated, wherein the ratio of the width 17 of the structural component to the height 18 of the structural component is roughly 1:1.5, whereas, according to FIG. 4, said ratio is marginally above 1:3.

As can be seen from FIGS. 6 and 7, the ratio 1:1.5 results in a stronger S-shaped curvature of the webs 3, 4, which is admissible if the webs 3, 4 have adequate flexibility and will lead to increased stability, especially if shearing forces occur between the flanges 16 on the upper side of the constructional element 15 and the flanges 2 on the lower side of the constructional element 15.

FIG. 8 illustrates an embodiment similar to that of FIG. 6, in this case, however, the cavities 11 are filled with PU-foam 19, which also contributes to an increase in load-bearing strength. According to requirements (sound insulation, increase in load-bearing strength, thermal insulation, etc.), said cavities 11 can be filled with different materials.

FIG. 10 shows a constructional element 15', formed by an embodiment of structural components 1', wherein the two webs 3', 4' attached to the flange 2 in each case extend toward either sides of the flange 2 and both end regions 7, 7' of the two webs 3', 4' are planarly interconnected with the surfaces facing each other. Because of this, the webs 3', 4' exhibit a stretched double-S in their cross-sections.

In FIG. 11, a device 20 for producing a structural component 1 as shown in FIG. 1 is illustrated. Said device 20 comprises a box-shaped tunnel 21 which is reinforced by frames 22 which are spaced apart in the longitudinal direction thereof in order to absorb outwardly acting forces.

At the bottom 23 of the tunnel, ledges 24 are located in a clearance which is slightly larger than the thickness 25 of two interconnected end regions 7 of the webs 3, 4. Said ledges 24 form grooves 26 with, so to speak, parallel walls, the height of said grooves likewise being dimensioned so as to be slightly larger than the height via which the two end regions 7 of the webs 3, 4 are interconnected. The width of the webs preferably corresponds to the width of a flange 2.

Figure 12:
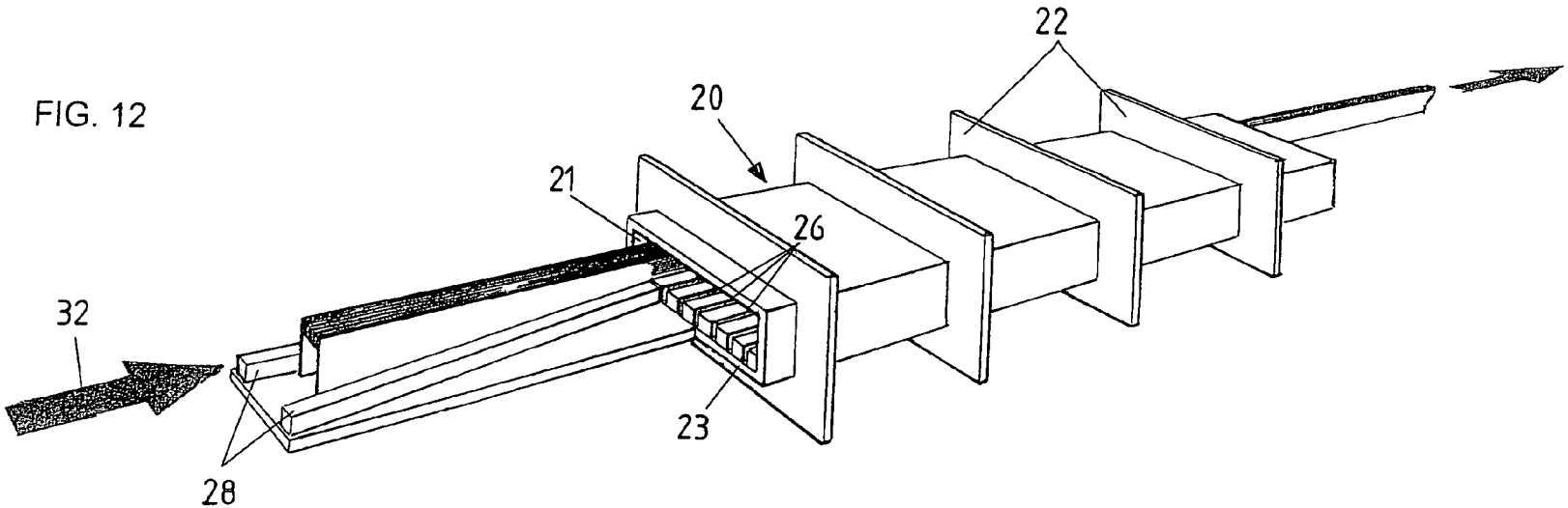
Figures 13A, 13B, 13C, 13D:
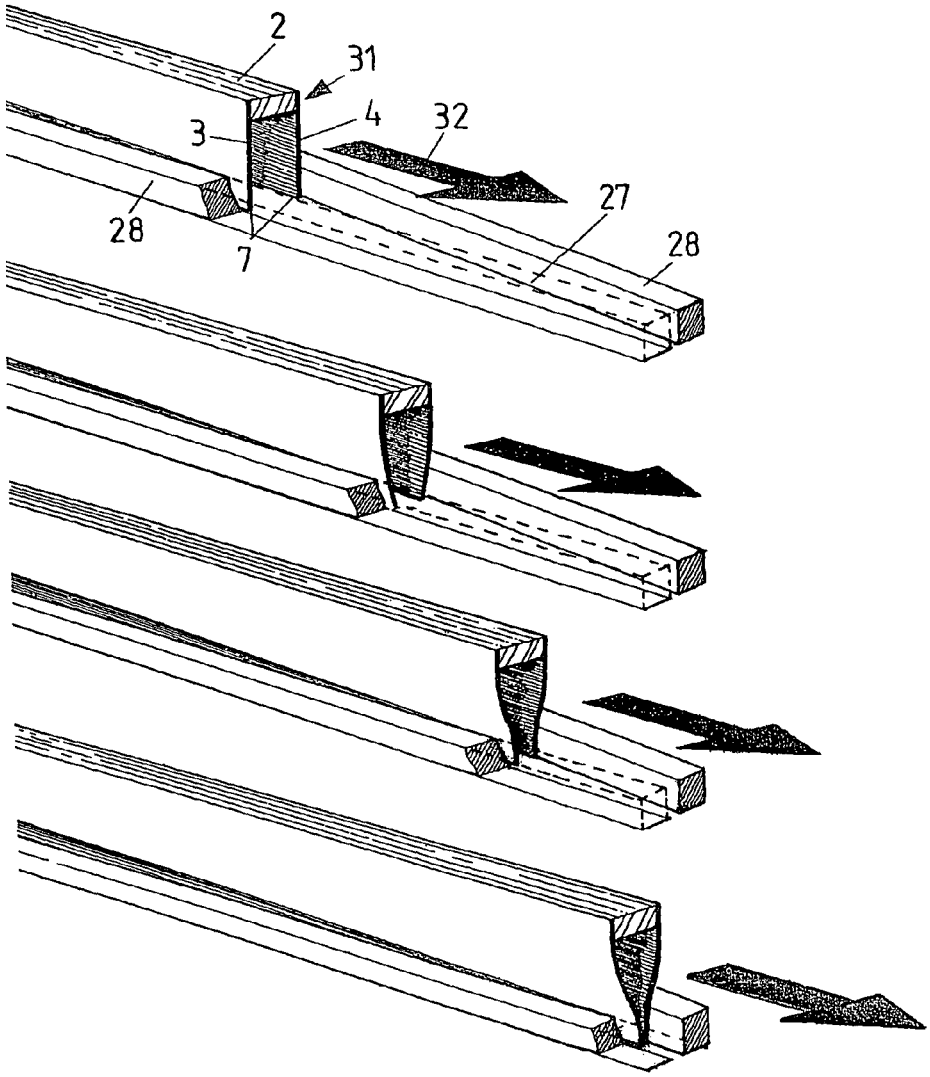
FIGS. 13A to D show the operation of the device, also in an oblique view layout.

A wedge-shaped groove 27, also formed by ledges 28 of roughly the same type as the legdes 24, is provided on a support device 29 which is displaceable from one groove with parallel walls 26 to another groove with parallel walls 26 in the direction of the arrows 30. Said wedge-shaped groove 27 whose wedge form tapers in the longitudinal direction toward the grooves with parallel walls 26 serves for receiving a structural-component blank 31 formed by a flange 2 and two webs 3, 4 extending alongside the flange 2 while being attached thereto, which webs are still undeformed and lie in parallel to each other, and for inserting said blank into the groove with parallel walls 26 if the structural-component blank is displaced in the direction of the arrow 32 of FIG. 12, with the end regions 7 of the webs 3, 4 being pressed against each other. For this purpose, the end regions 7 of the webs 3, 4, which are to be interconnected, have previously been coated with an adhesive material. In order to prevent the structural-component blank 31 from jumping out of the groove with parallel walls 27—which is caused by compressive forces arising during the deformation of the webs 3, 4—the height of the tunnel 21 is dimensioned such that the flange 2, as can be seen in FIG. 12, will lie against the inner surface 33 of the tunnel 21, which inner surface is located opposite the grooves with parallel walls 26. By way of FIGS. 13A to 13D, it is shown how the deformation of the webs 3, 4 proceeds during the longitudinal displacement along the wedge-shaped groove 27.

The displacement of the structural-component blank 31 can be effected by compressive forces or also by tensile forces, it is particularly advantageous to guide a rope through the cavity of the structural-component blank 31, which cavity is located between the webs 3, 4, and to fasten said rope to the rear end thereof and to expose the rope, which also extends through the tunnel 21, to tensile forces with the aid of a rope winch, which tensile forces cause the movement of the structural-component blank 31 in the direction of the arrow 32.

The formation of plate-shaped constructional elements 15 from the individual structural components 1 and 1', respectively, suitably occurs in a press bed in which adjacent structural components 1, 1' are pressed against each other, upon previous application of adhesive to the sides abutting each other. Beforehand, however, flanges 16 corresponding to a flange 2 of a structural component 1, 1' were inserted between the free end regions 7 of the interconnected webs 3, 4 and 3', 4', respectively, of the individual structural components 1, 1'.

If wood is used, the interconnection of the webs 3, 4, 3', 4' with the flanges 2, 16 or the structural components 1, 1', respectively, is preferably effected by means of a glue, in particular a synthetic resin glue, in case of other materials for the individual elements of the structural component, the connection of said individual parts is effected according to the respective type, i.e., for example by soldering, welding, screwing, etc.

The invention claimed is:

1. A beam-like structural component (1, 1') made up of individual parts, comprising a flange (2) and two webs (3, 4; 3', 4'), characterized in that a flange (2) is provided with one web (3, 4; 3', 4') each on its two longitudinal sides, wherein each web is attached to a longitudinal sidewall of the flange (2) by an adhesive, and that the end regions (7, 7') of the webs (3, 4; 3', 4'), which end regions are facing away from the flange (2), are planarly interconnected with the surfaces (8, 9) facing each other by an adhesive, wherein the webs (3, 4; 3', 4'), in their cross-sections, have in each case the shape of a "stretched S", with at least some curvature.

2. A structural component according to claim 1, characterized in that each web (3, 4; 3', 4') covers the entire longitudinal sidewall of the flange (2) to which it is attached across the entire height thereof.

3. A structural component according to claim 2, characterized in that the ends of the webs (3, 4) extending along the longitudinal sidewall of the flange (2) terminate flush with at least a portion of the outside (14) of the flange (2), due to machining on the assembled structural component (1) or on a blank of the structural component (31), respectively.

4. A structural component according to claim 1, characterized in that the ratio of the width (17) to the height (18) ranges between 1:20 and 1:1.

5. A structural component according to claim 1, characterized in that it is formed of wood, with the flange (2) being manufactured from sawn timber and the webs (3, 4; 3', 4') being manufactured from plywood.

6. A structural component according to claim 5, characterized in that the webs (3, 4; 3', 4') are formed from a three-layered plywood, with the wood fibres of the two outer layers of the plywood extending in the longitudinal direction of the structural component (1, 1').

7. A structural component according to claim 1, characterized in that glues, in particular synthetic resin glues, are used as adhesive materials.

8. A structural component according to according to claim 1, characterized in that the cavity formed by the webs (3, 4; 3', 4') and the flange (2) is filled with a material such as, for example, silica sand, cellulose flakes, a foamed material, PU-foam, etc.

9. A structural component according to according to claim 1, characterized in that the planarly interconnected end regions (7, 7') of the webs (3, 4; 3', 4') lie in the centre of the width of the flange (2).

10. A structural component according to according to claim 1, characterized in that an intermediate web (12) extending from the flange (2) as far as to the planarly interconnected end regions (7) of the webs (3, 4) is provided.

11. A structural component according to claim 10, characterized in that the intermediate web (12) abuts the inside of the flange (2).

12. A structural component according to claim 10, characterized in that the intermediate web (12) extends through the flange (2) to the outside (14) thereof.

13. A structural component according to according to claim 10, characterized in that the intermediate web (12) is connected to the structural component (1) by means of an adhesive.

14. A structural component according to claim 1, characterized in that the two webs (3', 4') attached to the flange (2) extend toward either sides of the flange (2) and both end regions (7, 7') of the two webs are planarly interconnected with the surfaces facing each other, the webs (3', 4') in each case having a "double-S" in their cross-sections.

15. A structural component according to claim 14, characterized in that the flange (2) is arranged on a central plane of symmetry of the structural component (1').

16. A constructional element (15) formed by at least two structural components (1, 1') according to claim 1 which are arranged next to each other and are connected to each other at the height of the flange, by means of an adhesive.

17. A constructional element according to claim 16, characterized in that at least two structural components (1, 1') are arranged so as to lie next to each other, wherein the flanges (2) of the two structural components (1, 1') form a surface and the structural components (1, 1') are interconnected with the end regions (7, 7') of the webs (3, 4; 3', 4') arranged on the flanges (2), which end regions are adjacent in this case, by an adhesive, and that a flange (16) located opposite the flanges (2) of the structural components (1, 1') is inserted between the two free planarly interconnected end regions (7, 7') of the webs (3, 4; 3', 4') of the adjacent structural components (1, 1') and is connected to the end regions (7, 7') of the planarly interconnected webs (3, 4; 3', 4') by an adhesive.

18. A plate-shaped constructional element according to claim 16, characterized by a plurality of structural components (1, 1') located next to each other and comprising a plurality of flanges (16) located opposite the flanges (2) of the structural components (1, 1').

* * * * *